United States Patent [19]

Faulconer

[11] 4,334,420

[45] Jun. 15, 1982

[54] TUBE GUIDE

[75] Inventor: William M. Faulconer, Bartlesville, Okla.

[73] Assignee: Phillips Petroleum Co., Bartlesville, Okla.

[21] Appl. No.: 147,402

[22] Filed: May 6, 1980

[51] Int. Cl.[3] ..... B21B 41/00

[52] U.S. Cl. ..... 72/250; 72/98; 72/227; 72/428

[58] Field of Search ..... 72/95, 98, 227, 250, 72/428; 226/196; 82/38 A

[56] References Cited

U.S. PATENT DOCUMENTS

| | | | |
|---|---|---|---|
| 2,936,811 | 5/1960 | Skawden et al. | 72/95 |
| 3,060,773 | 10/1962 | Stroms | 72/428 |
| 3,071,032 | 1/1963 | Teplitz | 72/250 |
| 3,501,937 | 3/1970 | Pierce | 72/250 |
| 3,541,904 | 11/1970 | Guntner | 82/38 A |
| 3,688,542 | 9/1972 | Platko | 72/250 |
| 3,690,134 | 9/1972 | Valonis | 72/250 |
| 3,752,259 | 8/1973 | Wright et al. | 82/38 A |
| 3,911,708 | 10/1975 | Lorenz et al. | 72/98 |
| 4,049,173 | 9/1977 | Alecha | 226/196 |
| 4,065,989 | 1/1978 | Scheler | 82/38 A |
| 4,100,827 | 7/1978 | Flemming | 82/38 A |
| 4,131,964 | 1/1979 | Cottingham | 82/38 A X |
| 4,179,957 | 12/1979 | Sewing | 82/38 A |
| 4,242,895 | 1/1981 | Boshold et al. | 72/257 |

FOREIGN PATENT DOCUMENTS

| | | | |
|---|---|---|---|
| 505061 | 8/1930 | Fed. Rep. of Germany | 72/250 |
| 709976 | 9/1941 | Fed. Rep. of Germany | 72/250 |
| 2312311 | 12/1976 | France | 72/428 |

*Primary Examiner*—Lowell A. Larson

[57] ABSTRACT

Guiding unit protecting against the whipping motion of a free pipe end in a pipe straightening is provided for, which comprises hinged sections of a piece of plastic pipe.

17 Claims, 3 Drawing Figures

TUBE GUIDE

BACKGROUND OF THE INVENTION

Straightening of metal tubing is a widely employed technology for instance for the production of straight tubing useful in heat exchanger equipment. One of the problems arising in the straightening machines resides in the fact that the free end of the tubing is put into whipping motions, particularly during high speed operation of such straightening machines.

One method that has been used to confine the whipping about of the free end of the bent tubing is a rectangular wooden box which has a limited life and the impacting of the tubing against the sides of the box results in an objectionable noise level in the working area.

It has been proposed in the art to counteract this whipping motion by using a straightening machine table. This straightening machine table is composed of a plurality of sections that can be inclined with respect to the horizon at varying degrees thus providing a segmented bent support for the tubing. This approach to the problem is mechanically involved. Such a table is described in U.S. Pat. No. 2,936,811.

THE INVENTION

It is one object of this invention to provide a piping straightening machine having an improved feeding or guiding unit.

A further object of this invention is to prevent or limit the whipping motion of a free pipe end in the feeding or guiding unit.

Still a further object of this invention is to limit the possible whipping motion of the free end of a pipe entering a pipe straightening machine while at the same time leaving the machine readily accessible.

Another object of this invention is to provide a guiding unit for a pipe straightening machine with a tolerable noise level during its use.

Yet a further object of this invention is to provide a guiding unit that is useful for and can be attached to a pipe straightening machine and which is simple in construction.

Figure 1:
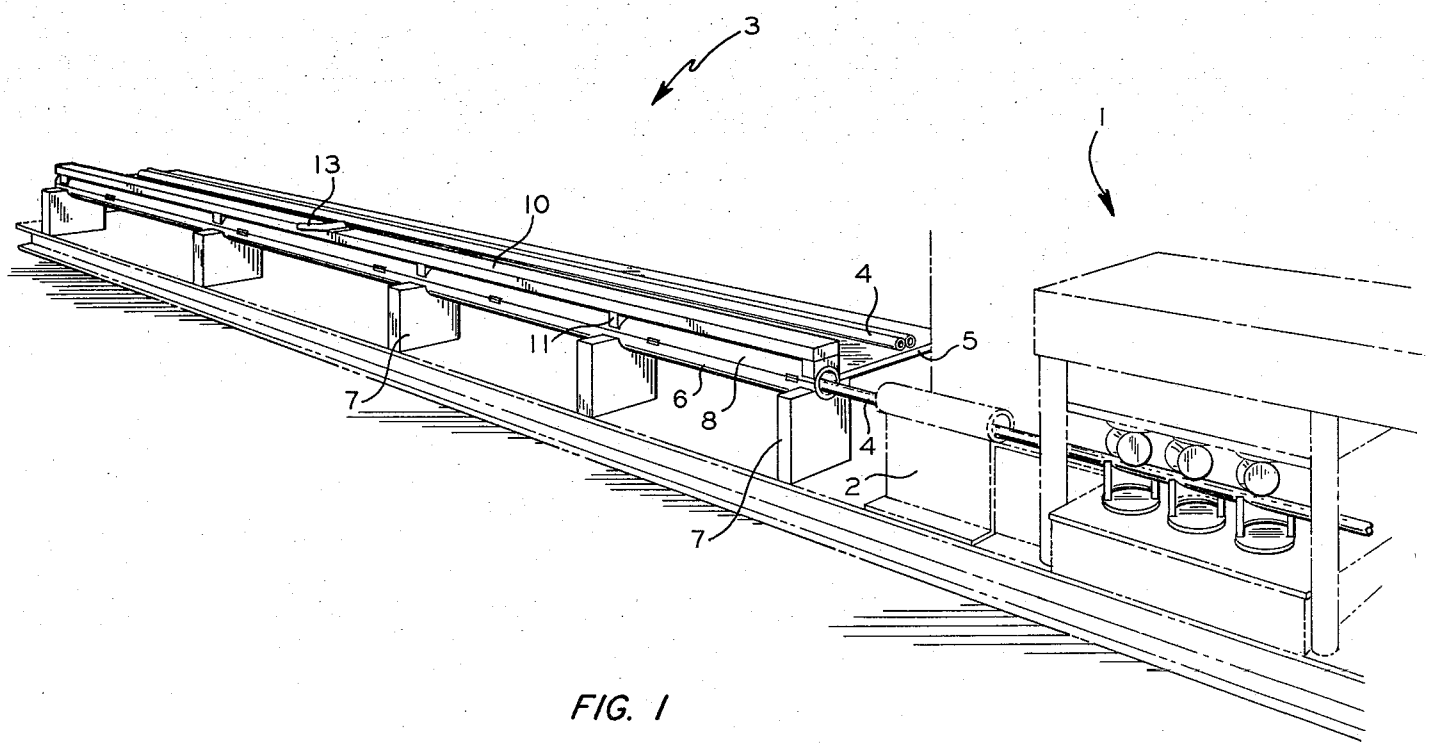
Figures 2, 3:
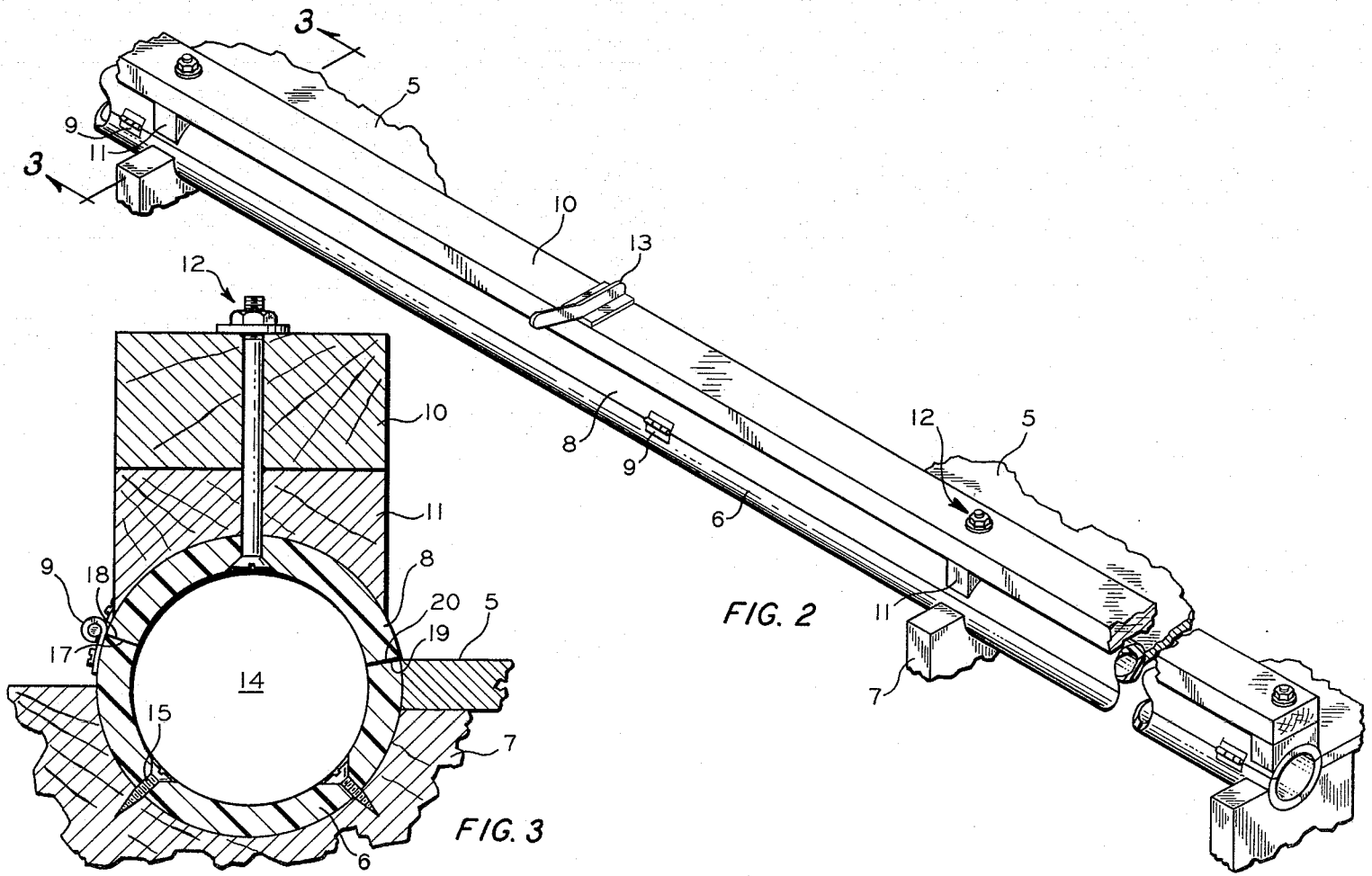

These and other objects, advantages, details, features and embodiments of this invention will become apparent to those skilled in the art from the following detailed description of the invention, the appended claims and the drawing which shows in FIG. 1 a prospective view of the pipe straightening unit (schematically) and the guiding unit of this invention, FIG. 2 an enlarged view of the guiding unit of this invention and in FIG. 3 a cross section through a unit shown in FIG. 2 along lines 3—3.

In accordance with this invention, a pipe straightening machine which comprises a pipe straightening unit is improved. The pipe straightening unit has a pipe inlet end and a machine axis defining the location of the pipe axis in the straightening unit. The improvement of this invention comprises a pipe end guiding unit having the axis of the guiding unit and the machine axis arranged essentially coextensive. The guiding unit which constitutes the improvement in the pipe straightening machine of this invention is described in more detail in the following.

In accordance with a second embodiment of this invention a guiding unit is provided for which can be used as an attachment to tubing or pipe treating equipment. This guiding unit comprises a first section of essentially C-shaped cross section. Furthermore, the unit comprises a second section of essentially C-shaped cross section, the first and second sections together in closed position of the unit forming a cylindrical compartment. The guiding unit further comprises hinging means connecting the first and second section with the hinge axis parallel to the axis of the sections. This allows the opening of the cylindrical compartment defined by the two hinged sections. The unit also comprises support means supporting fixedly and attached to the first section and stiffening means associated with the second section.

The particular shape of the edges of the first and second section is not critical. These longitudinal edges are essentially parallel to the cylinder axis and preferably are plane. Other structures of these edges such as a softened structure are of course possible.

Generally, the first and second sections will be of essentially the same length. This feature again is not a typical necessity and the actual length will be determined by practical considerations. The top or second section of the tube may be longer covering the free distance between the guiding unit and the feed inlet end to the tubing or pipe treating equipment to which this unit is attached.

The sections can be made from plastic pipe made from commonly employed tough thermoplastic material. Examples of such thermoplastic materials useful are polyethylene, polypropylene, ABS polymers, and polyvinylchloride. The presently preferred material is high density high molecular weight polyethylene or copolymers of ethylene and mono-olefin comonomer having 4–10 carbon atoms such as 1-butene or 1-hexene. Such polymers are commercially available. High density polyethylene resins such as Marlex$^R$ polyethylenes sold by Phillips Petroleum Co. of Bartlesville, Okla. are suitable and particularly the pipe grade of these plastics is advantageously used.

The stiffening means attached to the one section is preferably designed to have two functions, namely to be used as a sound deadener and as a reinforcing bar. This structure, therefore, preferably comprises a bar which has roughly the same length as the second section to which it is attached. The bar is fixedly attached to the second section at a plurality of locations by spacer bars there between.

Advantageously, but not necessarily, the first section of the two sections encompasses more than a half-cylinder and the second cylinder correspondingly comprises less than a half-cylinder. In terms of the cylinder circumference the smaller second section comprises an angle in the range of 120°–175°.

When used in guiding operations where the guiding unit has to withstand strong impacts from the free end, a whipping or bent pipe as it feeds into the straightening machine, the guiding unit can be provided with one or more locking devices such as quick opening latches along the parting line. The locking device would prevent the two sections from opening under the impact of the whipping pipe inside. This locking device is associated with those edges of the first and second sections that are not hinged together. In straightening operations involving small diameter pipe, the weight of the components, later described, is sufficient keep the cylindrical compartment closed.

As a general rule the internal diameter of the cylindrical compartment provided by the two sections when they are closed is at least about twice as large as the largest diameter of the pipe or tubing contemplated to be treated in the pipe straightening unit.

FIG. 1 schematically shows the pipe straightening apparatus together with the guiding unit of this invention. The pipe straightening apparatus is schematically shown as unit 1. A guide 2 is provided at the inlet end of unit 1 and the guiding unit 3 is coaxially aligned with the inlet guide 2 and the pipe straightening unit 1.

Pipes 4 are shown arranged on table 5 ready to be put into the pipe guiding unit 3 and to be fed into the straightening unit 1. The details of the apparatus of the feeding and guiding unit 3 are shown in more detail in connection with FIGS. 2 and 3. The lower and larger or first section 6 is attached to supports 7 by means of screws 15. The upper and smaller or second section 8 is connected to the lower section 6 by means of hinges 9 along edges 17 and 18 and meet along the parting line formed by edges 19 and 20 to form cylindrical compartment 14 which is open at both ends.

The upper second section 8 is reinforced by a bar 10 which is attached to the upper section 8 by means of holding and spacer blocks 11 and a nut, bolt, and washer arrangement 12. A grip or handle 13 is connected to the bar 10 allowing the easy and protected opening of the cylindrical compartment even while the pipe 4 is moving through this compartment.

A typical example of a guiding unit for a pipe straightening unit for the production of heat exchanger pipe of 0.750" OD or smaller can have the following dimensions:

Length of the two sections 6 & 8: 39' (11.8 meters)

Internal diameter of the cylindrical compartment 14: 3.54" (8.98 cm)

Wall thickness of the sections 6 & 8: 0.482" (1.22 cm)

The cylindrical compartment formed by sections 6 and 8 can be constructed from 4½ OD (11.43 cm) Driscopipe sold by Phillips Driscopipe Co. of Dallas, Tex. Supports 7, stiffening bar 10 and spacer blocks 11 can be constructed from wood. A guiding unit so constructed will confine the whipping end of the tubing while providing a reduced noise level over the prior art.

The separate components of the guiding unit as shown are readily replaceable in case the wear should have reduced the strength of the sections 6 and 8 to the extent that a replacement thereof is warranted. Assembly and dissassembly of the unit also can readily be done.

Reasonable variations and modification which will become apparent to those skilled in the art can be made in this invention without departing from the spirit and scope thereof.

I claim:

1. In a pipe straightening machine comprising a pipe straightening unit having a pipe inlet end and a machine axis defining the location of the pipe axis in the straightening unit the improvement comprising a noise level reducing pipe end guiding unit comprising (a) a first elongated section of essentially C-shaped cross section made from thermoplastic material, (b) a second elongated section of essentially C-shaped cross section made from thermoplastic material, said first and second cross section together in the closed position of the unit forming a cylindrical compartment confining the whipping end of pipes straightened in said straightening unit, said cylindrical compartment having an internal diameter which is at least twice as large as the largest diameter of the pipe or tubing to be treated in said straightening unit, and having an open end facing said unit, (c) hinging means connected to said first and said second sections with the hinge axis being parallel to the axis of said sections, to allow the opening of said cylindrical compartment, (d) support means supporting said first elongated section, (e) stiffening means associated with said second elongated section.

2. Machine in accordance with claim 1 wherein the facing edges of the first and second elongated section are essentially parallel to the cylinder axis of said cylindrical compartment.

3. Machine in accordance with claim 1 wherein said first and second sections have essentially the same length.

4. Machine in accordance with claim 1 wherein said first and second sections are made from plastic material selected from the group consisting of polyethylene, polypropylene, copolymers of ethylene and mono-olefin comonomer, and polyvinylchloride.

5. Machine in accordance with claim 1 wherein said first and second sections have been constructed from plastic pipe.

6. Machine in accordance with claim 1 wherein said stiffening means comprises a reinforcing bar having roughly the same length as the section to which it is attached and wherein said bar is fixedly attached to said second section at a plurality of locations with spacer bars between said second section and said reinforcing bar.

7. Machine in accordance with claim 1 wherein said first section encompasses more than half a cylinder and the complementary second section encompasses correspondingly less than half a cylinder.

8. Machine in accordance with claim 1 further comprising a locking device for locking the two sections and preventing inadvertant opening thereof.

9. Machine in accordance with claim 8 wherein said locking device is associated with the edges of said sections along a parting line.

10. A guiding unit for confining tubing being treated in a tubing straightener machine comprising (a) a first elongated section of essentially C-shaped cross section, (b) a second elongated section of essentially C-shaped cross section, said first and second section together in the closed position of the unit forming a cylindrical compartment, said first section and said second section having been cut out of one piece of plastic pipe, (c) hinging means connecting said first and said second section with the hinge axis being parallel to the axis of said sections, to allow the opening of said cylindrical compartment, (d) support means supporting said first section, (e) stiffener means associated with the second of said sections.

11. Unit in accordance with claim 10 wherein the longitudinal edges of the first and second section are parallel to the axis of the cylindrical compartment.

12. Unit in accordance with claim 10 wherein said first and second sections have essentially the same length.

13. Unit in accordance with claim 10 wherein said first and second sections consist essentially of a plastic or mixture of plastics selected from the group consisting of polyethylene, polypropylene, or copolymers of ethylene and mono-olefin comonomer, and polyvinylchloride.

14. Unit in accordance with claim 10 wherein said stiffener means comprise a bar having roughly the same length as the second section it is associated with and wherein the bar is attached to this section at a plurality of locations with spacer bars therebetween.

15. Unit in accordance with claim 10 wherein the first section encompasses more than half a cylinder and the complementary section encompasses correspondingly less than half a cylinder.

16. Unit in accordance with claim 10 further comprising a locking device for locking the two sections and prevent inadvertant opening thereof.

17. Unit in accordance with claim 16 wherein said locking device is associated with the edges of said sections along a parting line.

* * * * *